US008616189B2

(12) United States Patent
McPherson et al.

(10) Patent No.: US 8,616,189 B2
(45) Date of Patent: Dec. 31, 2013

(54) FLEXIBLE CABLE GUARD

(75) Inventors: Mathew A. McPherson, Norwalk, WI (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/406,204

(22) Filed: Feb. 27, 2012

(65) Prior Publication Data

US 2012/0204851 A1 Aug. 16, 2012

Related U.S. Application Data

(63) Continuation-in-part of application No. 12/569,738, filed on Sep. 29, 2009, now Pat. No. 8,402,960.

(60) Provisional application No. 61/101,562, filed on Sep. 30, 2008.

(51) Int. Cl.
*F41B 5/14* (2006.01)
*F41B 5/10* (2006.01)

(52) U.S. Cl.
CPC .... *F41B 5/14* (2013.01); *F41B 5/10* (2013.01)
USPC ..... 124/88; 124/23.1; 124/25.6; 124/86

(58) Field of Classification Search
CPC ..... F41B 5/14; F41B 5/10
USPC ..... 124/23.1, 25.6, 86, 88
See application file for complete search history.

(56) References Cited

U.S. PATENT DOCUMENTS

| | | | | | |
|---|---|---|---|---|---|
| 4,061,125 | A | | 12/1977 | Trotter | |
| 4,203,412 | A | | 5/1980 | Rickard | |
| 4,377,152 | A | * | 3/1983 | Saunders | 124/88 |
| 4,452,222 | A | * | 6/1984 | Quartino et al. | 124/23.1 |
| 4,461,267 | A | | 7/1984 | Simonds et al. | |
| 4,542,591 | A | * | 9/1985 | Montgomery | 33/265 |
| 4,542,732 | A | * | 9/1985 | Troncoso | 124/25.6 |
| 4,628,892 | A | * | 12/1986 | Windedahl et al. | 124/25.6 |
| 4,819,611 | A | | 4/1989 | Sappington | |
| 4,886,038 | A | * | 12/1989 | Betters | 124/25.6 |
| 4,903,678 | A | * | 2/1990 | Walker | 124/90 |
| 4,917,070 | A | * | 4/1990 | Townsend | 124/23.1 |
| 4,919,108 | A | * | 4/1990 | Larson | 124/88 |
| 5,002,035 | A | * | 3/1991 | Brooks | 124/23.1 |
| 5,103,798 | A | * | 4/1992 | McGraw et al. | 124/88 |
| 5,161,514 | A | * | 11/1992 | Cary | 124/24.1 |
| 5,178,122 | A | * | 1/1993 | Simonds | 124/25.6 |
| 5,323,756 | A | | 6/1994 | Rabska | |
| 5,368,006 | A | | 11/1994 | McPherson | |

(Continued)

OTHER PUBLICATIONS

U.S. Appl. No. 12/569,738, filed Sep. 29, 2009.

(Continued)

*Primary Examiner* — Gene Kim
*Assistant Examiner* — Alexander Niconovich
(74) *Attorney, Agent, or Firm* — Vidas, Arrett & Steinkraus

(57) ABSTRACT

In some embodiments, a compound archery bow comprises a riser, first and second limbs and first and second rotatable members. A bowstring extends between the first rotatable member and the second rotatable member. A power cable is biased in a direction away from the riser by a cable guard comprising a mounting portion attached to the riser, a flexible portion and a cable engaging portion. In some embodiments, the cable guard comprises a roller.

20 Claims, 8 Drawing Sheets

(56) References Cited

U.S. PATENT DOCUMENTS

| | | | | | |
|---|---|---|---|---|---|
| 5,392,757 | A | * | 2/1995 | Head et al. | 124/86 |
| 5,415,149 | A | * | 5/1995 | Derus et al. | 124/23.1 |
| 5,433,792 | A | * | 7/1995 | Darlington | 124/25.6 |
| 5,553,597 | A | * | 9/1996 | Sparks | 124/44.5 |
| 5,553,600 | A | * | 9/1996 | Miller | 124/86 |
| 5,555,874 | A | * | 9/1996 | Savage | 124/1 |
| 5,651,355 | A | * | 7/1997 | Gallops, Jr. | 124/25.6 |
| 5,718,213 | A | | 2/1998 | Gallops, Jr. et al. | |
| 5,720,269 | A | * | 2/1998 | Saunders | 124/86 |
| 5,791,324 | A | * | 8/1998 | Johnson | 124/25.6 |
| D412,021 | S | | 7/1999 | Gray | |
| 5,983,880 | A | * | 11/1999 | Saunders | 124/25.6 |
| 6,098,607 | A | | 8/2000 | Strother | |
| 6,152,124 | A | | 11/2000 | Gallops, Jr. | |
| 6,178,958 | B1 | | 1/2001 | Gallops, Jr. | |
| 6,382,201 | B1 | | 5/2002 | McPherson et al. | |
| 6,425,385 | B1 | | 7/2002 | Gallops, Jr. | |
| 6,443,139 | B1 | | 9/2002 | McPherson | |
| 6,550,467 | B2 | | 4/2003 | Gallops, Jr. | |
| 6,634,348 | B2 | * | 10/2003 | Gallops, Jr. | 124/25.6 |
| 6,655,371 | B2 | * | 12/2003 | Gallops, Jr. | 124/25.6 |
| 6,681,753 | B2 | * | 1/2004 | Afshari | 124/44.5 |
| 6,708,684 | B2 | * | 3/2004 | Chattin | 124/25.6 |
| 6,715,479 | B1 | * | 4/2004 | Bunk | 124/25.6 |
| 6,722,354 | B1 | * | 4/2004 | Land | 124/25.6 |
| 6,745,756 | B1 | | 6/2004 | Achkar | |
| 6,889,679 | B2 | * | 5/2005 | Chattin | 124/25.6 |
| 6,904,900 | B2 | | 6/2005 | Gallops, Jr. | |
| 6,966,314 | B2 | | 11/2005 | McPherson | |
| 7,100,591 | B2 | * | 9/2006 | Terry | 124/44.5 |
| 8,028,685 | B2 | * | 10/2011 | Clark | 124/25.6 |
| 8,307,816 | B2 | * | 11/2012 | Darlington | 124/88 |
| 2009/0145411 | A1 | * | 6/2009 | Sims et al. | 124/25.6 |
| 2010/0101549 | A1 | * | 4/2010 | Grace et al. | 124/25.6 |
| 2010/0282226 | A1 | * | 11/2010 | Marzullo | 124/25.6 |
| 2011/0011385 | A1 | * | 1/2011 | Grace et al. | 124/25.6 |
| 2011/0073090 | A1 | * | 3/2011 | McPherson | 124/25.6 |
| 2011/0192385 | A1 | * | 8/2011 | Clark | 124/25.6 |
| 2012/0272939 | A1 | * | 11/2012 | Grace et al. | 124/25.6 |

OTHER PUBLICATIONS

U.S. Appl. No. 61/101,562, filed Sep. 30, 2008.

Bowtech Archery Website; Accessed on Jun. 7, 2012; http://www.bowtecharchery.com/#/technologyBreakdown?r=products_technology&i=6.

* cited by examiner

FLEXIBLE CABLE GUARD

CROSS-REFERENCE TO RELATED APPLICATIONS

This application claims the benefit of U.S. patent application Ser. No. 12/569,738, filed Sep. 29, 2009, which claims the benefit of U.S. Provisional Patent Application No. 61/101,562, filed Sep. 30, 2008, the entire disclosures of which are hereby incorporated herein by reference.

BACKGROUND OF THE INVENTION

This invention relates to compound bows, and more specifically to cable guards used in compound bows. Compound bows are well known in the field of archery, an activity that involves skill, accuracy, and precision. When an arrow is fired, it is desirable to minimize any vertical travel and/or horizontal travel of the rear of the arrow shaft, in order to achieve consistent and accurate arrow launch.

Compound bows typically have a rotatable member at each end of the bow—of which at least one is typically a cam assembly, a first cable (e.g. a bow string) in communication with the rotatable members and a second cable (e.g. a power cable) in communication with the cam assembly. Some compound bows include an anchor cable, such as a one-cam bow, or multiple power cables, such as a two-cam bow.

Fixed, relatively stiff cable guards have previously been used to displace the power cable(s) and/or the anchor cable laterally, moving them out of the shooting plane proximate to the arrow's travel path. Such cable guards also prevent the arrow from contacting the displaced cable(s) during draw back and release. However, the lateral displacement generally applies a force to the rotatable members and to the bow's limb tips, which can result in undesirable nock travel during arrow launch. With modern compound bows having a shorter axle-to-axle distance between the rotatable members than prior bow designs, the negative effects of traditional cable guards have been amplified. The result is a need for novel cable guard designs that provide for a significant reduction in the forces applied to the free ends of the bow limbs as compared to prior designs.

All US patents and applications and all other published documents mentioned anywhere in this application are incorporated herein by reference in their entirety.

U.S. patent application Ser. No. 12/700,612 is hereby incorporated herein by reference in its entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is also provided for the purposes of complying with 37 C.F.R. §1.72. The abstract is not intended to be used for interpreting the scope of the claims.

BRIEF SUMMARY OF THE INVENTION

In some embodiments, a compound archery bow comprises a riser, first and second limbs and first and second rotatable members. A bowstring extends between the first rotatable member and the second rotatable member. A power cable is biased in a direction away from the riser by a cable guard comprising a mounting portion attached to the riser, a flexible portion and a cable engaging portion. In some embodiments, the cable guard comprises a roller.

In some embodiments, a compound archery bow comprises a riser, first and second limbs and first and second rotatable members. A bowstring extends between the first rotatable member and the second rotatable member. A power cable is biased in a direction away from the riser by a cable guard comprising a mounting portion attached to the riser, a flexible portion and a roller contacting the cable.

In at least one embodiment of the invention, a cable guard of an archery bow comprises a mounting portion, a cable engaging portion, and a main body connecting the mounting portion to the cable engaging portion. The main body portion comprises a flexible material. In at least one embodiment, the flexible material is a different material than the material used in the mounting portion and the material used in the cable engaging portion. In at least one embodiment, the flexible material is a composite material, in particular a fiberglass composite. In at least one embodiment, the flexible material is selected from the group consisting of spring steels or a composite material containing, fiberglass, carbon, Kevlar®, Vectran®, UHMWPE, Dyneema®, Spectra® and other materials used for springs.

In at least one embodiment, the flexible material has a modulus of elasticity between about $5\times10^6$ kPa and $6.5\times10^6$ kPa. In at least one embodiment, the main body portion has an inner surface with a curvilinear profile. In at least one embodiment, the main body portion comprises at least one member that connect the cable engaging portion with the mounting portion.

When the bow is in a brace position, the cable guard is in a first position. As the bowstring is displaced from the brace position to the full draw position, the cable engaging portion moves to a second position, the second position being closer to the plane of the bowstring than the first position.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING(S)

FIG. 2A shows a perspective view of the cable guard, and FIG. 2B shows a top plan view of the cable guard.

Figure 1:
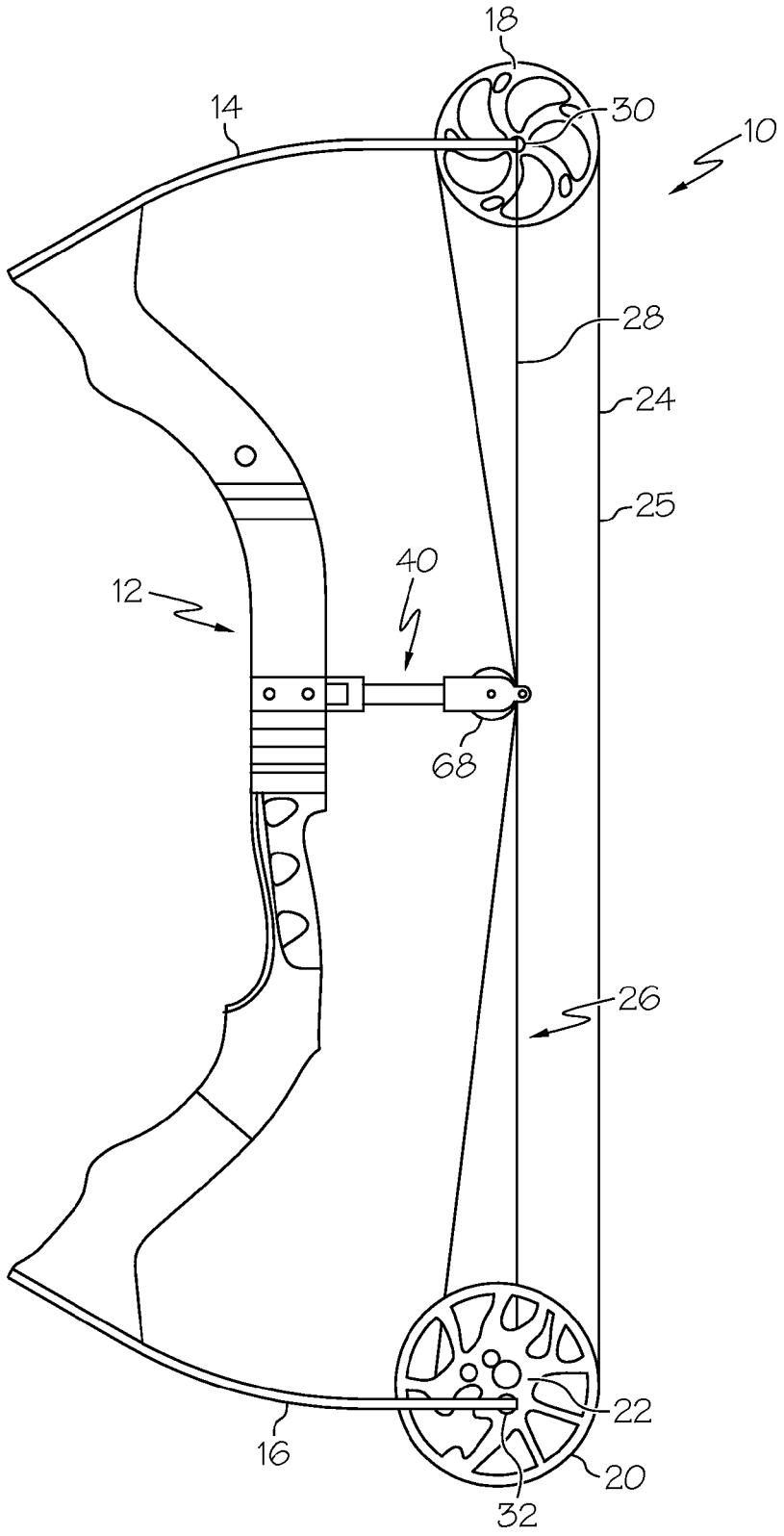
FIG. 1 shows a side view of a compound bow with an embodiment of the cable guard of the present invention.
Figure 4A:
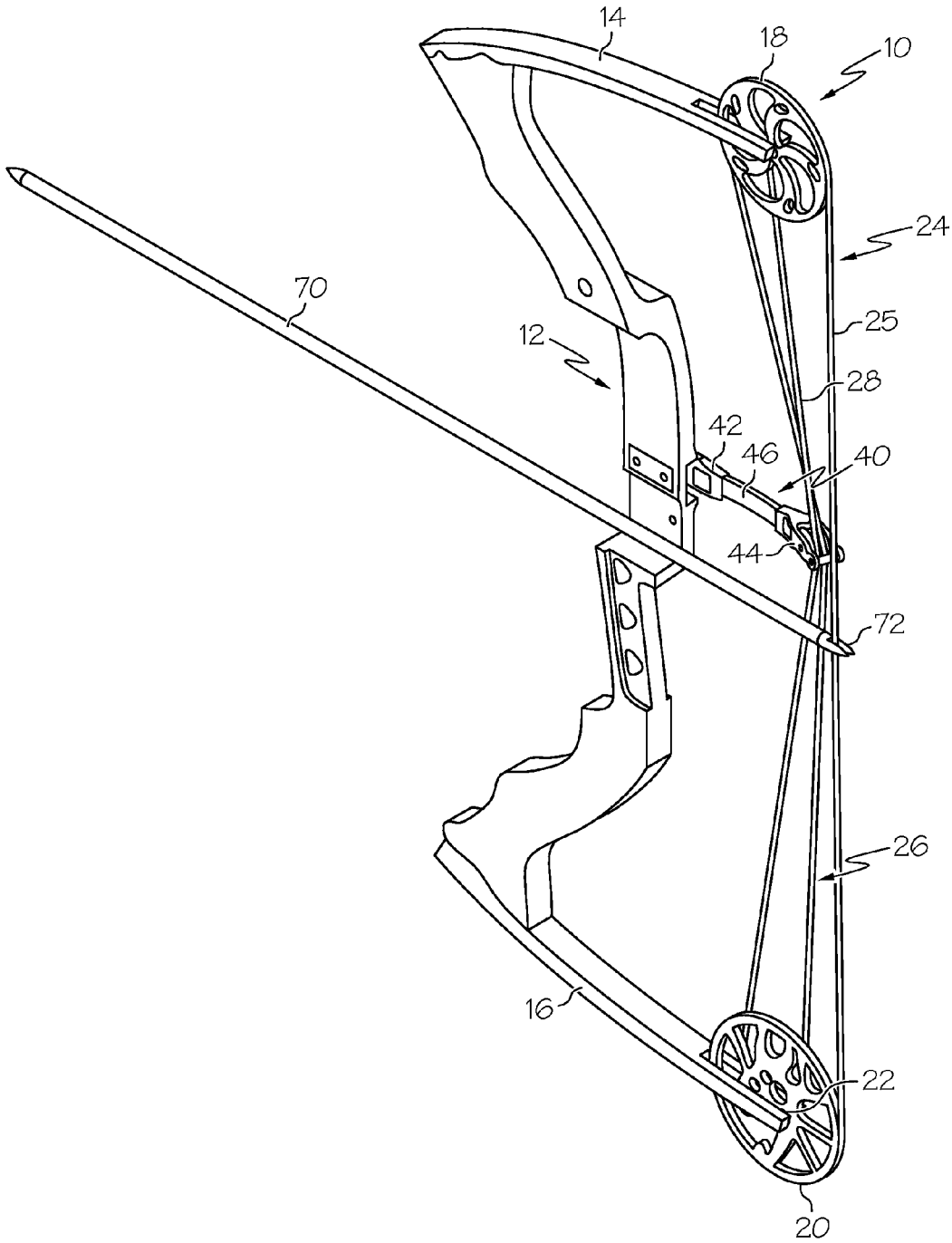
Figure 4B:
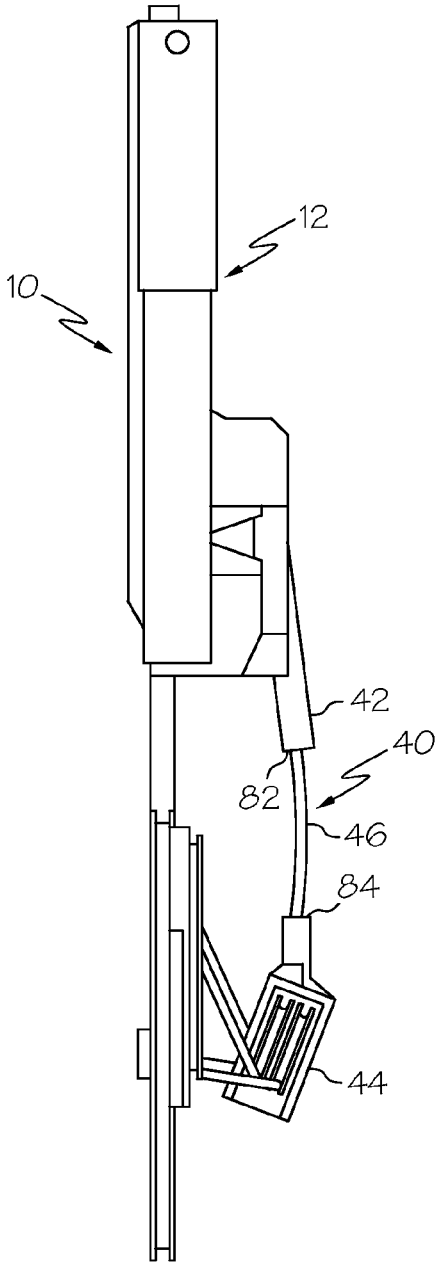
Figure 4C:
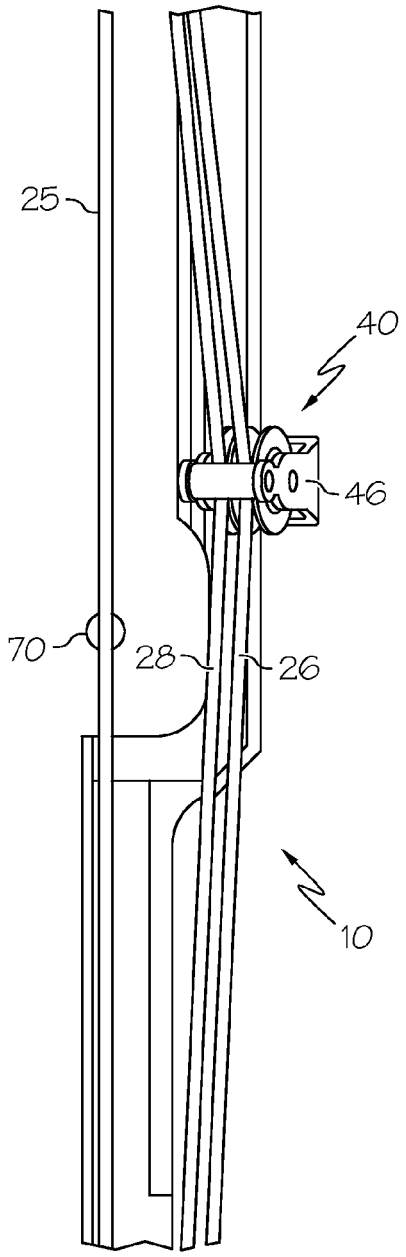

FIGS. 4A-4C show the compound bow of FIG. 1, the compound bow in a brace position. FIG. 4A shows a perspective view of the compound bow. FIG. 4B shows a top view of a portion of the compound bow. FIG. 4C shows a rear view of a portion of the compound bow.

Figure 5A:
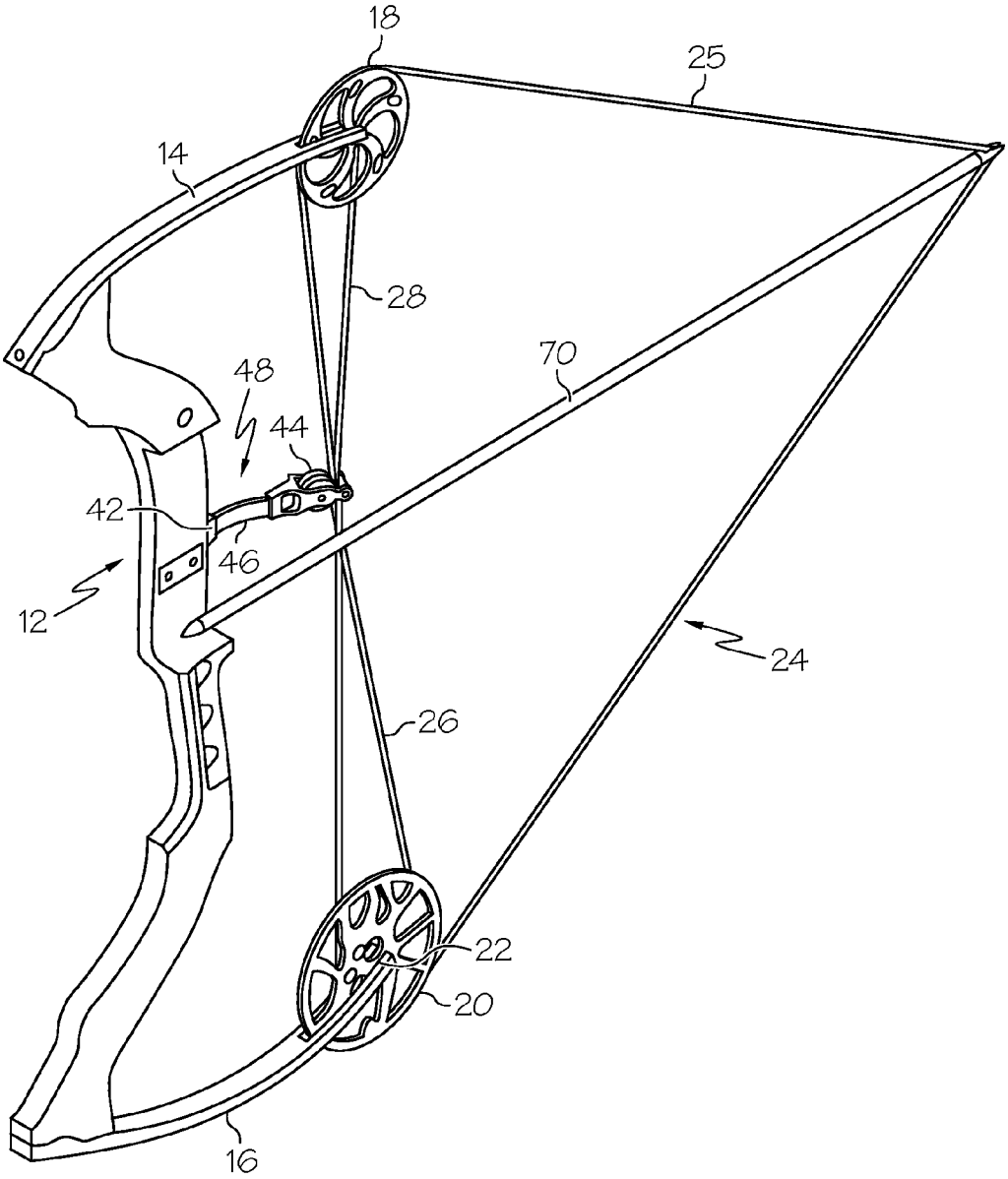
Figure 5B:
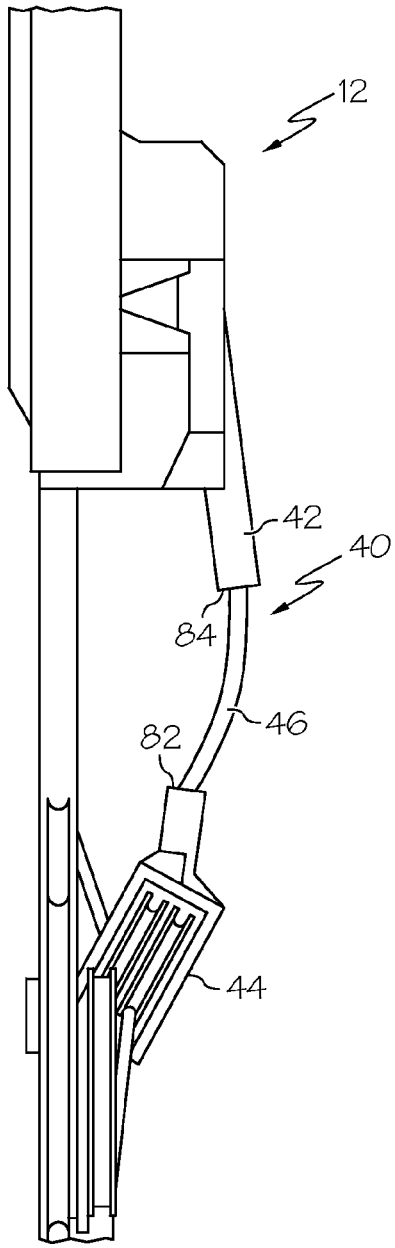
Figure 5C:
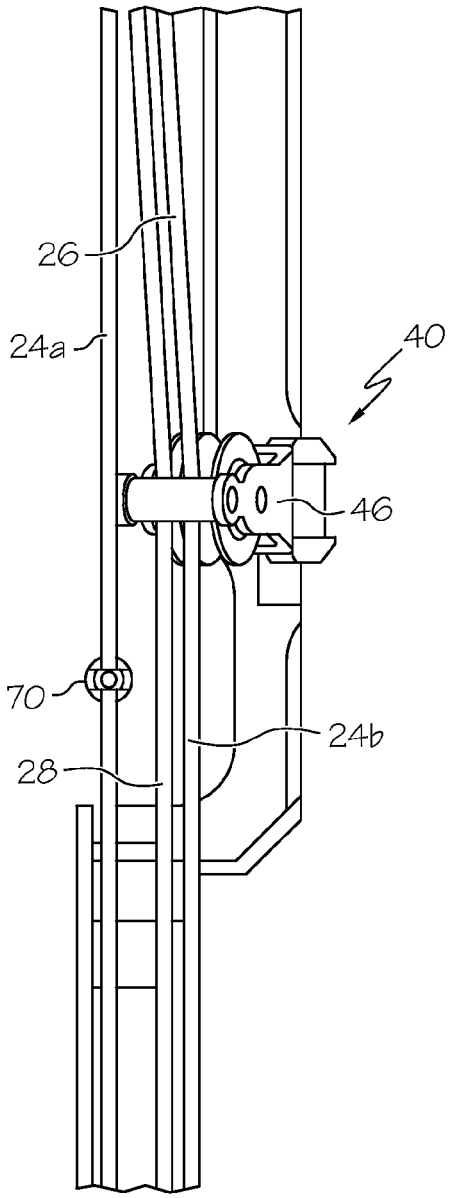

FIGS. 5A-5C show the compound bow shown in FIGS. 4A-4C, the compound bow in a fully drawn position. FIG. 5A shows a perspective view of the compound bow. FIG. 5B shows a top view of a portion of the compound bow. FIG. 5C shows a rear view of a portion of the compound bow.

Figure 6:
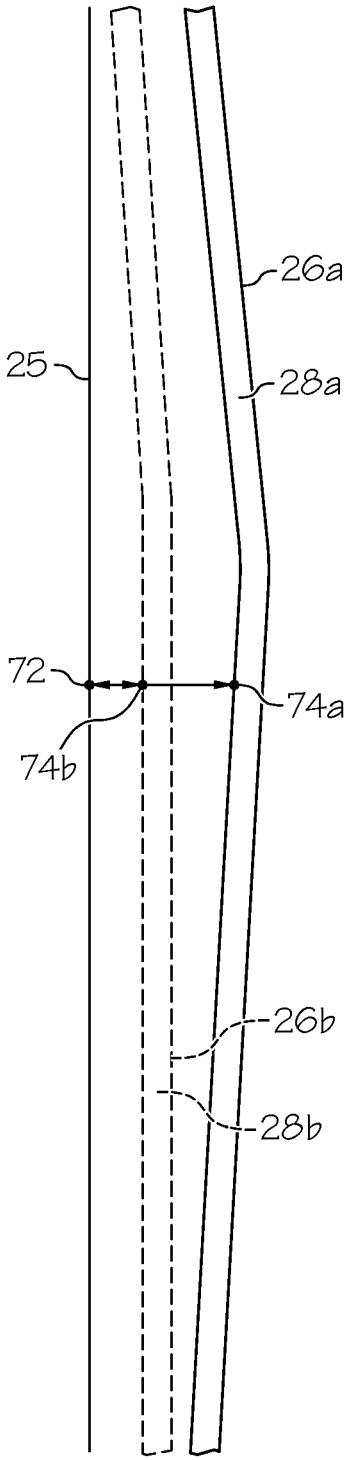

FIG. 6 shows a schematic view of a portion of FIG. 4C super-imposed over a portion of FIG. 5C.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a compound bow 10 such as described in U.S. Pat. Nos. 5,368,006 and 6,443,139, both incorporated herein by reference. Although the present invention can be used with any suitable type of archery bow (including, but not limited to, single-cam bows, CPS bows and/or cam-and-a-half bows, dual-cam bows and/or twin-cam bows, crossbows, etc.), a compound bow 10 is shown in FIG. 1 as a single-cam compound bow.

As shown in FIG. 1, the bow 10 generally comprises a riser 12, a first limb 14, a second limb 16, rotatable members 18 and 20, a cam assembly 22, a first cable 24, and a second cable 28. The inner ends of limbs 14, 16 are connected at opposite ends of the riser 12. Rotatable member 18 is rotatably supported on an axle 30 near the outer end of first limb 14, and rotatable member 20 is rotatably supported on an axle 32 near the outer end of second limb 16. Each rotatable member can comprise a cam, a pulley or any other suitable rotatable member. In the embodiment shown, rotatable member 20 comprises a cam assembly 22.

The first cable 24 has a first section 25 (typically referred to as "the bowstring") and a second section 26 (in this case referred to as a secondary payout). The first cable 24 extends from rotatable member 20, is trained around rotatable member 18 and extends back to terminate on the rotatable member 20. In particular, bowstring 25 portion can be considered the portion of the first cable 24 that an archer grasps and draws, which extends between the first and second rotatable members 20, 22. The second section 26 extends between the first and second rotatable members but is not grasped by an archer. The second cable 28 (typically referred to as "the power cable") is anchored at one end to an outer portion of the first limb 14, for example being attached to the limb 14 itself, the axle 30, or in some embodiments, a portion of the rotatable member 18, for example as described in U.S. Pat. No. 8,020,544, the entire disclosure of which is hereby incorporated herein by reference. The second cable 28 is anchored at the other end to the cam assembly 22. When the archer draws the bowstring 25 back, the rotatable member having cam assembly 22 rotates and bowstring 25 is fed out from rotatable member 18. The secondary payout cable 26 is fed out from rotatable member 20 and in turn fed out from rotatable member 18 to give the bowstring 25 more length as the archer approaches full draw. As the bowstring 25 is fed out from the rotatable member 20, the power cable 28 is taken up in the cam assembly 22. The effective reduced length and increased tension in the second (power) cable 28 during bowstring draw back shortens the axial distance between the rotatable members 18, 20, causing flexure of limbs 14, 16. While the above disclosure describes a single-cam, compound bow, similar functions occur with CPS bows and/or cam-and-a-half bows, dual-cam bows and/or twin-cam bows, crossbows, and the like.

FIG. 1 also shows an embodiment of flexible cable guard 40 of the present invention. As strung, the secondary payout cable 26 and the power cable 28 tend to be aligned in nearly a single plane with bowstring 25. Cable guard 40 holds the secondary payout cable 26 as well as the power cable 28 in place and out of the plane of bowstring 25. Thus, the secondary payout cable 26 and the power cable 28 are not in the way when an archer shoots an arrow.

As shown in FIG. 1, cable guard 40 is attached to the riser 12 between the first limb 14 and the second limb 16. In FIG. 1, the cable guard 40 is shown attached to the riser 12 of the bow 10. The cable guard 40 can be attached to any suitable portion of the riser 12, such as a side of the riser 12, the front of the riser 12 or the back 34 of the riser 12. Additionally, the cable guard 40 can be attached to more than one side of the riser 12, for example the back 34 and first side 32, as shown in FIG. 1. Additionally the flexible portion of the cable guard 40 may be attached directly to the bow handle/riser 12.

Figure 2A:
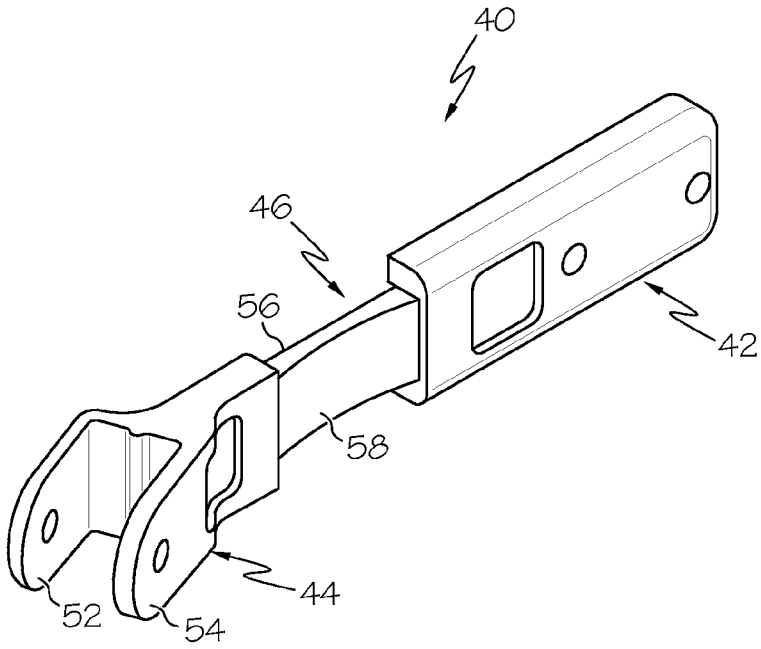
FIGS. 2A-2B show an embodiment of the cable guard.
Figure 2B:
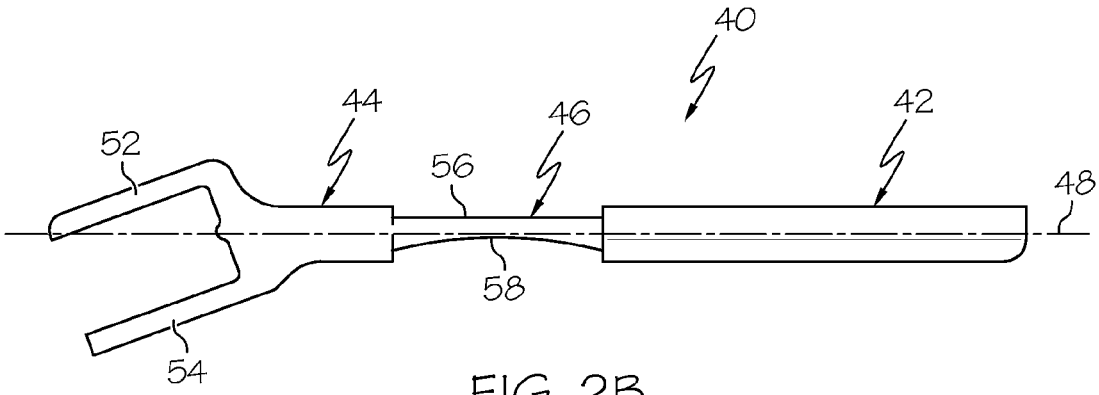

FIGS. 2A-2B show cable guard 40 of FIG. 1 in further detail. In some embodiments, cable guard 40 has a mounting portion 42, a cable engaging portion 44, and a main body portion 46 connecting the mounting portion 42 with the cable engaging portion 44. When viewed along the longitudinal axis 48 of the cable guard 40, the mounting portion 42 is axially aligned with main body portion 46 and the cable engaging portion 44.

The mounting portion 42 can be attached to the riser 12 of the bow 10 as shown in FIG. 1. In some embodiments, the mounting portion 42 is comprised of a first material that is different than at least the main body portion 46. In some embodiments, the mounting portion 42 and the cable engaging portion 44 can be comprised of the same materials or different materials. Alternately, the mounting portion 42 and the flexible main body portion 46 can be made as a single unit of a material that is different than the cable engaging portion 44.

In some embodiments, the cable engaging portion 44 may have rollers, grooves, slots, or similar features that retain cables 26, 28 away from bowstring 25, while allowing the cables 26, 28 to slide as needed when the bowstring 25 is drawn back from the brace position or when the bowstring 25 is released and returned to the brace position.

In at least one embodiment, cable engaging portion 44 is a roller housing that holds a set of rollers (see e.g. FIG. 1) between an outer wall 52 and an inner wall 54. In at least one embodiment, outer wall 52 is parallel with inner wall 54, and both outer wall 52 and inner wall 54 are angularly offset from mounting portion 42 and main body portion 46. In at least one embodiment, the rollers (see e.g. FIG. 1) contact or engage the cables 26, 28 and allow the cable guard 40 to hold secondary payout cable 26 of first cable 24 as well as second cable 28 in place (see FIG. 1), while allowing the cables to be fed out or taken up as the archer draws bowstring 25. As noted above, other mechanisms may be used in cable guard 40 to allow the cables to be fed out or taken up, while still retaining the cables 26, 28 in place and away from bowstring 25.

In some embodiments, a cable guard 40 comprises a separate roller for each cable 26, 28 engaged by the cable guard. With reference to FIG. 1, a roller 68 is typically supported upon an axis of rotation 68. In some embodiments, the cable guard 40 biases the cable(s) 26, 28 in a direction away from the riser 12. For example, in some embodiments, the biasing includes a component oriented in or parallel to the bowstring plane, wherein the component is directed away from the riser. The axis of rotation 68 may be located between the cable 28 and the riser 12. In some other embodiments, the cable(s) 26, 28 can extend between the riser 12 and the axis of rotation 68.

The main body portion 46 connects mounting portion 42 with cable engaging portion 44. The main body portion 46 comprises a flexible material. In at least one embodiment, the flexible material used for the main body portion 46 is a different material than the material used for the cable engaging portion 44. In some embodiments, the flexible material of the main body portion 26 has a modulus of elasticity of less than $6.5\times10^6$ kPa (942 ksi). In at least one embodiment, the flexible material of the main body portion 26 has a modulus of elasticity in the range of between about $5\times10^6$ kPa (725 ksi) and $6.5\times10^6$ kPa (942 ksi).

In some embodiments, the flexible material comprises a spring steel or any other material that is suitable for forming a spring member to be used as the body portion 26. In some embodiments, the flexible material comprises a composite material. The body portion 26 can comprise suitable metals, fiberglass, carbon, aramid fibers, Kevlar®, Vectran®, Ultra-high-molecular-weight polyethylene, Dyneema®, Spectra®, other suitable materials and suitable combinations thereof. A number of these alternative materials have a considerably higher modulus of elasticity. Therefore to attain the proper cable guard flexibility it is necessary to control the section modulus of the shapes used in the flexible portion of the cable guard based on the chosen material.

FIG. 1 shows an embodiment of a cable guard 40 having rollers, wherein the cables 26, 28 contact the rollers. As shown, the cables 26, 28 are biased in a direction away from the riser 12. As shown, each cable 26, 28 contacts a roller on a surface of the roller that is oriented opposite the riser 12. For example, an axle that supports the roller is oriented between the riser 12 and a contact location between the roller and cable 26, 28.

In some embodiments, the cable guard 40 biases the cables 26, 28 in a direction toward the riser 12. In some embodiments, each cable 26, 28 contacts a roller on a surface of the roller that is oriented closest to the riser 12.

In the embodiment shown in FIGS. 2A-2B, the main body portion 46 is a single member with a substantially rectangular cross-section. The main body portion 46 has an outer surface 56 and an inner surface 58. In the embodiment shown, the inner surface 58 has a curved profile. The curvature of the inner surface 58 assists with the flexibility of the main body portion 46, and the change in thickness of the main body portion 46 as compared to the amount of flexure allows for a predetermined force profile.

Figure 3:
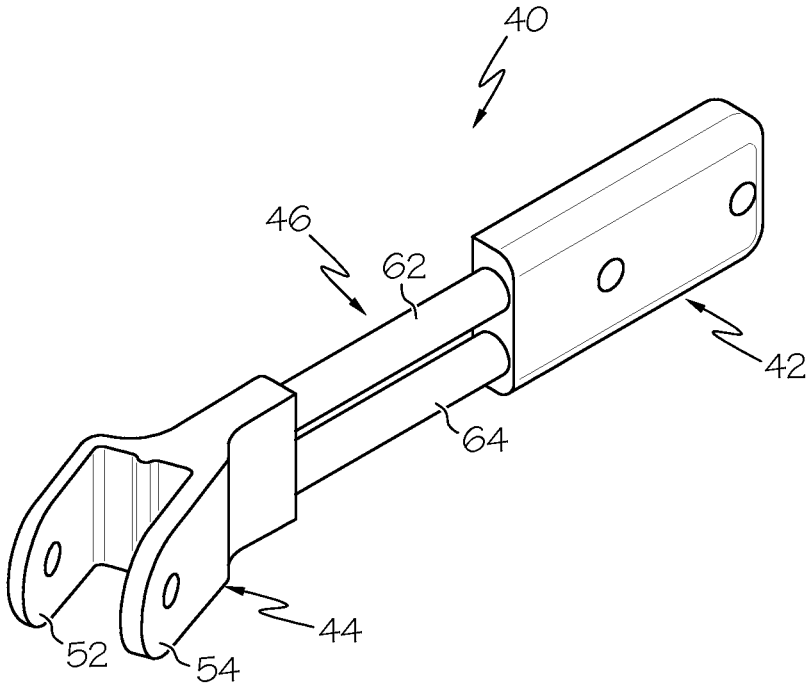
FIG. 3 shows a perspective view of an embodiment of the cable guard.

FIG. 3 shows another embodiment, wherein the main body portion 46 comprises multiple members 62, 64 made from a flexible material. In some embodiments, the main body portion 46 can comprise or consist of one or more different flexible cross-section configurations. Shown in FIG. 3, the members 62, 64 are circular in cross-section, however the desired cross section could be any suitable geometric shape, and may be solid or hollow.

FIGS. 4A-4C show perspective, top, and rear views, respectively, of the bow 10 shown in FIG. 1 in a brace position. The bow 10 is fitted with the flexible cable guard 40. As shown in FIGS. 4A-4C, cable guard 40 is a reverse cable guard similar to that as described in commonly owned, co-pending application Ser. No. 12/569,738 entitled "Archery Bow," the entireties of which are incorporated herein by reference. Cable guard 40 engages cables 26, 28 in a position towards the archer. In this configuration, the rollers of the cable guard 40 contact cables 26, 28 at the end of the cable engaging portion 44 closest to the archer. The cables 26, 28 are biased away from the riser (e.g. towards the archer). The cables 26, 28 are also biased in a direction away from the plane of bowstring 25 travel.

While FIG. 4A-4C shows cable guard 40 as a reverse cable guard, cable guard 40 may also be configured as a standard cable guard, the rollers of the cable guard 40 engage cables 26, 28 in a position away from the archer. In such a configuration, the cables 26, 28 are held between the rollers and the cable engaging portion 44 near where the end of the cable engaging portion 44 that attaches the body portion 46. The cables 26, 28 are then biased towards the riser and away from the archer. While FIGS. 4A-4*c* show the cable guard 40 on a single-cam compound bow, cable guard 40 may also be used on CPS bows and/or cam-and-a-half bows, dual-cam bows and/or twin-cam bows, crossbows, and the like. In some of these bows, such as dual-cam or twin-cam bows, there can be two power cables that are engaged with the rollers of the cable guard.

In FIGS. 4A-4C, there is a minimum tension on each of the cables 24, 28. Bow 10 in FIG. 4A has an arrow 70 held near a nock point 72 on the bowstring 25. From a top view of compound bow 10, as shown in FIG. 4B, the mounting portion 42 is substantially axially aligned with the main body portion 46 and a portion of the roller housing 44. FIG. 4C shows a view of the compound bow 10 from the rear (or the archer's perspective). In FIGS. 4B and 4C the cables 26 and 28 are displaced out of the flight path of the arrow and away from the bow string 25 to the extent that an arrow having three fletchings in a standard configuration can be launched without the fletching contacting either of the cables 26 or 28. Ideally with the bow in the brace condition as can be seen in FIG. 4C the cable 28 (which is closest to the plane of the bowstring) is being held such that its closest surface to the flight path of the arrow is in plane with the inside surface of the bows sight window. Preferably the nearest surface of either cable 26 or 28 to the plane of the bowstring with the bow in the brace condition is about 0.5" (this takes into consideration a fletching height of ⅝" mounted on an arrow shaft having a diameter of 26/64").

FIGS. 5A-5C show perspective, top, and rear views of bow 10 of FIGS. 4A-4C in a fully drawn position. As the bowstring 25 is drawn back, tension increases significantly in at least one of the cables 26, 28 (e.g. power cable 28) up to a maximum tension until the bow 10 reaches the fully drawn position shown in FIGS. 5A-5C. As a result of this increased load on the cable(s) 28 and the flexible material of main body portion 46, flexible cable guard 40 deflects inwardly as the bowstring 25 is drawn back. As shown most clearly in a comparison between FIG. 4B and FIG. 5B, under full draw conditions, main body portion 46 deflects to allow the cable engaging portion 44 to move inwardly, while mounting portion 42 remains rigidly in place. When the bow 10 is fully drawn as shown in FIG. 5B, the inner surface 58 of main body portion 46 has a greater degree of curvature than when the bow 10 is in brace position, as shown in FIG. 4B. Also, an axial distance between the end 84 of the mounting portion 42 adjacent the main body portion 46 and the end 82 of the cable engaging portion 44 adjacent main body portion 46 is decreased as compared to the same axial distance in FIG. 4B. In other words, the cable engaging portion 44 is moved away from the archer towards the riser 12. As shown in FIG. 5C, the cable engaging portion 44 also moves inwardly towards the plane of the bowstring 25 in the fully drawn position versus the brace position shown in FIG. 4C. However, cables 26, 28 are not in the way of the bowstring 25, nor do they contact the arrow 70. By bringing cables 26, 28 closer to the bowstring 25, the loads imposed by cables 26, 28 at the limb tips of the bow are minimized, resulting in less horizontal displacement of the limb tips and rotating components at full draw. This in turn results in less horizontal displacement of the plane of the bowstring at full draw and less horizontal movement of the nock end of the arrow during launch as the bowstring returns to its original plane as it reaches brace position.

Without cable guard 40, cables 26, 28 naturally align in the same plane as the bowstring 25. In a brace position, cable guard 40 holds cables 26, 28 at a first position (as shown in FIG. 4C) away from the plane of the bowstring 25. As the bowstring 25 is drawn, cable guard 40 holds cables 26, 28 at a second position (as shown in FIG. 5C), which is somewhere between the first position and the plane of the bowstring 25. Ideally, cable guard 40 will flex enough at full draw that the second position is as close to the plane of the bowstring 25 as possible, without the cables 26, 28 actually coming in contact with the arrow shaft. If the cables 26, 28 are kept a minimum of 0.25" from the plane of the bowstring at full draw, they will not interfere with the largest of today's arrow shafts, which may be 27/64" in diameter. In some embodiments, the cable guard 40 only deflects in the horizontal direction.

FIG. 6 shows the relative relationship between the bowstring 25, the cables 26*a*, 28*a* at brace position (as shown in FIG. 4C) and the cables 26*b*, 28*b* at full draw (as shown in FIG. 5C). Nock point 72 is shown on the schematic. Desirably, at brace position, the cables 26*a*, 28*a* are held away from the nock point 72 at a first minimum distance of approximately ½" measured at the nock point 72 and a point 74*a* along cable 28*a*. At full draw, the cables 26*b*, 28*b* are held away from the plane of the nock point 72 at a second minimum distance which is at least one-half of the maximum arrow shaft diameter that is intended to be used or approximately 0.25" between the nock point 72 and a point 74*b* along cable 28*b*. The second distance should be as close as possible in order to minimize transverse horizontal travel of the nock end of the arrow during launch. In some embodiments, the second distance (between nock point 72 and point 74*b*) is less than 50% of the first distance (between nock point 72 and point 74*a*). In some embodiments, the second distance is between about 25% and 45% of the first distance. In some embodiments, the second distance is less than 40%. In some embodiments, the second distance is between about 33% and 40%.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

This completes the description of the preferred and alternate embodiments of the invention. Those skilled in the art may recognize other equivalents to the specific embodiment described herein which equivalents are intended to be encompassed by the claims attached hereto.

The invention claimed is:

1. A compound archery bow comprising:
- a riser;
- a first limb supporting a first rotatable member, said first rotatable member arranged to rotate about a first axis;
- a second limb supporting a second rotatable member, said second rotatable member arranged to rotate about a second axis, said first axis and said second axis defining a lateral plane;
- a cam assembly;
- a bowstring extending between the first rotatable member and the second rotatable member, said bowstring moving in a bowstring plane as the bow is drawn;
- a cable in communication with said cam assembly; and
- a cable guard comprising:
  - a mounting portion attached to said riser;
  - a body portion comprising a flexible material; and
  - a cable engaging portion engaged with said cable;
- wherein a portion of said cable guard extends through said lateral plane and said cable guard biases said cable in a direction away from said riser, said biasing including a component oriented in, or parallel to, said bowstring plane, said component directed away from the riser.

2. The bow of claim 1, said cable guard comprising a roller, said roller contacting said cable.

3. The bow of claim 1, wherein said flexible material comprises a modulus of elasticity of less than $6.5\times10^6$ kPa (942 ksi).

4. The bow of claim 1 having a brace condition and a drawn condition, a contact location between the cable guard and the cable being substantially closer to said bowstring plane in said drawn condition than in said brace condition.

5. The bow of claim 4, wherein a distance between said bowstring plane and said contact location in said drawn condition is less than 50% of said distance in said brace condition.

6. The bow of claim 4, wherein a distance between said bowstring plane and said contact location in said drawn condition is less than 40% of said distance in said brace condition.

7. The bow of claim 1, wherein said flexible material comprises a spring steel.

8. The bow of claim 1, wherein said flexible material comprises a composite material comprising fiberglass, carbon, Kevlar®, Vectran®, UHMWPE, Dyneema® or, Spectra®.

9. The bow of claim 1, wherein said cable guard surrounds said cable.

10. The bow of claim 1, wherein the body portion comprises a curved sidewall.

11. The bow of claim 1, comprising a second cable, said cable guard biasing said second cable in a direction away from said riser.

12. A compound archery bow comprising:
- a riser;
- a first limb supporting a first rotatable member, said first rotatable member arranged to rotate about a first axis;

a second limb supporting a second rotatable member, said second rotatable member arranged to rotate about a second axis, said first axis and said second axis defining a lateral plane;

a cam assembly;

a bowstring extending between the first rotatable member and the second rotatable member, said bowstring defining a bowstring plane as the bow is drawn;

a cable in communication with said cam assembly; and a cable guard comprising:

a mounting portion attached to said riser;

a body portion comprising a flexible material; and a roller contacting said cable;

said cable guard biasing said cable in a direction away from said riser, said biasing including a component oriented in, or parallel to, said bowstring plane, said component directed away from said riser, said cable guard extending through said lateral plane.

13. The bow of claim 12, wherein said flexible material comprises a modulus of elasticity of less than $6.5\times10^6$ kPa (942 ksi).

14. The bow of claim 12, wherein said cable guard biases said cable in a direction away from said bowstring plane.

15. The bow of claim 12, wherein said roller is supported on a rotation axis, said rotation axis located between said riser and said cable.

16. The bow of claim 12, wherein said roller is supported on a rotation axis, said cable extending between said riser and said rotation axis.

17. The bow of claim 12 having a brace condition and a drawn condition, a contact location between the cable guard and the cable being substantially closer to said bowstring plane in said drawn condition than in said brace condition.

18. The bow of claim 17, wherein a distance between said bowstring plane and said contact location in said drawn condition is less than 50% of said distance in said brace condition.

19. The bow of claim 17, wherein a distance between said bowstring plane and said contact location in said drawn condition is less than 40% of said distance in said brace condition.

20. The bow of claim 12, wherein said flexible material comprises a material selected from a group consisting of: spring steels and composite materials containing fiberglass, carbon, Kevlar®, Vectran®, UHMWPE, Dyneema® or Spectra®.

* * * * *